United States Patent [19]

Campbell

[11] Patent Number: 4,998,986

[45] Date of Patent: Mar. 12, 1991

[54] CENTRIFUGAL JIG PULSING SYSTEM

[75] Inventor: Thomas P. Campbell, Coos Bay, Oreg.

[73] Assignee: Trans Mar, Inc., Spokane, Wash.

[21] Appl. No.: 471,097

[22] Filed: Jan. 25, 1990

[51] Int. Cl.[5] ..... B03B 5/12

[52] U.S. Cl. ..... 209/44; 209/425; 209/453; 209/500

[58] Field of Search ..... 209/44, 453, 425, 426, 209/427, 444, 494, 500, 17, 463, 468

[56] References Cited

U.S. PATENT DOCUMENTS

| | | | |
|---|---|---|---|
| 489,197 | 1/1893 | Pech | 209/453 |
| 4,056,464 | 11/1977 | Cross | 209/425 |
| 4,279,741 | 7/1981 | Campbell | 209/44 |
| 4,515,689 | 5/1985 | Vivier | 209/453 |
| 4,574,046 | 3/1986 | Sprow | 209/44 |
| 4,898,666 | 2/1990 | Kelsey | 209/44 |

FOREIGN PATENT DOCUMENTS

| | | | |
|---|---|---|---|
| WO82/02842 | 9/1982 | PCT Int'l Appl. . | |
| WO86/04269 | 7/1986 | PCT Int'l Appl. . | |
| 22995 | 8/1906 | Sweden . | |
| 47385 | 4/1917 | Sweden . | |
| 9000090 | 1/1990 | World Int. Prop. O. | 209/17 |

OTHER PUBLICATIONS

"Concentration of Fine Grained Heavy Minerals Using the Kelsey Centrifugal Jig,"Ausimm Perth Branch, Australia: Conference Sept.-Oct. 1986, by Capps and Waldram.

"Kelsey Centrifugal Jig,"Bulletin 8862 by Carpco, Inc.

USSR Inventor's Certificate No. 139,259 (1961)-Original Text and English Translation.

*Primary Examiner*—Donald T. Hajec

*Attorney, Agent, or Firm*—Wells, St. John & Roberts

[57] ABSTRACT

A centrifugal jig screen with a rotating hutch is supplied with inwardly directed pulses by overlapping fluid supply nozzles and pulse blocks coaxially arranged about the jig axis. Fluid not directed to the hutch interior in sharply defined pulses is diverted into a surrounding shroud, permitting the incoming fluid flow to be substantially uninterrupted during jig operation. Wedge surfaces about the hutch prevent buildup of separated materials as the are discharged from the hutch.

18 Claims, 4 Drawing Sheets

P
Y
10
11
12
13
14
15
16
17
18
19
20
21
23
25
27
30
31
32
34
35
36
37
40
41
42
43
44
45
46
48
50
51

CENTRIFUGAL JIG PULSING SYSTEM

TECHNICAL FIELD

This invention relates to jigs that utilize centrifugal force to enhance separation of heavy and light fractions of materials.

BACKGROUND OF THE INVENTION

The present invention pertains to improvements in the fluid pulsing system (liquid or gas) for centrifugal jigs. One specific type of liquid jig is disclosed in U.S. Pat. No. 4,279,741, issued July 21, 1981, which is hereby incorporated into this disclosure by reference. The general advantages and operational features of centrifugal jigs can be readily ascertained from the referenced patent. Depending upon the application of such jigs, either the heavy fraction or the light fraction separated by its operation might contain the values desired as an end product.

In the form of the centrifugal jig shown in FIG. 5 of the referenced U.S. patent, the rotating screen is associated with an exterior rotating hutch maintained full of liquid during jig operation. Fluid pulses are directed to the interior space of the fluid-filled hutch by a rotating supply valve in the form of a stationary head 62 provided with openings 64 that periodically register with similar openings 71 on a spinning rotor. When the openings 64 and 71 are not in registry with one another, flow of water in the head 62 is substantially stopped. The patent disclosure states that the complementary wall surfaces of the head and rotor will normally substantially nest and therefore very little seepage will be allowed into the hutch. However, by adjustment of shaft positions, steady seepage can be achieved to apply a continuous positive pressure to fluid within the hutch in addition to the positive pulsations required by the jig bed.

The present invention was developed to provide better definition to the jig pulses by producing more abrupt shock waves or pressure pulses that can be applied to the rotating hutch fluid. This is achieved by periodically directing continuously flowing pressurized fluid into the interior space of the hutch during rotation of the rotor without ever substantially obstructing the flow of the incoming pulse fluid. The fluid is alternately directed either to the interior space of the hutch or to the interior space of a surrounding shroud or enclosure. The present system makes efficient use of the dynamic energy contained within a constantly flowing supply of pressurized fluid by not obstructing movement of the incoming fluid that is periodically directed into the interior space of the hutch.

BRIEF DESCRIPTION OF THE DRAWINGS

The preferred embodiment of the invention is illustrated in the accompanying drawings, in which.

DETAILED DESCRIPTION OF THE PREFERRED EMBODIMENTS

The following disclosure of the invention is submitted in compliance with the constitutional purpose of the Patent Laws "to promote the progress of science and useful arts" (Article 1, Section 8).

This disclosure pertains to any centrifugal jig utilizing a pulsed fluid medium to separate heavy and light fractions within an incoming fluid slurry. The pulsed fluid medium, and the slurry, can be either liquid or gas, depending upon the materials being separated.

Figure 1:
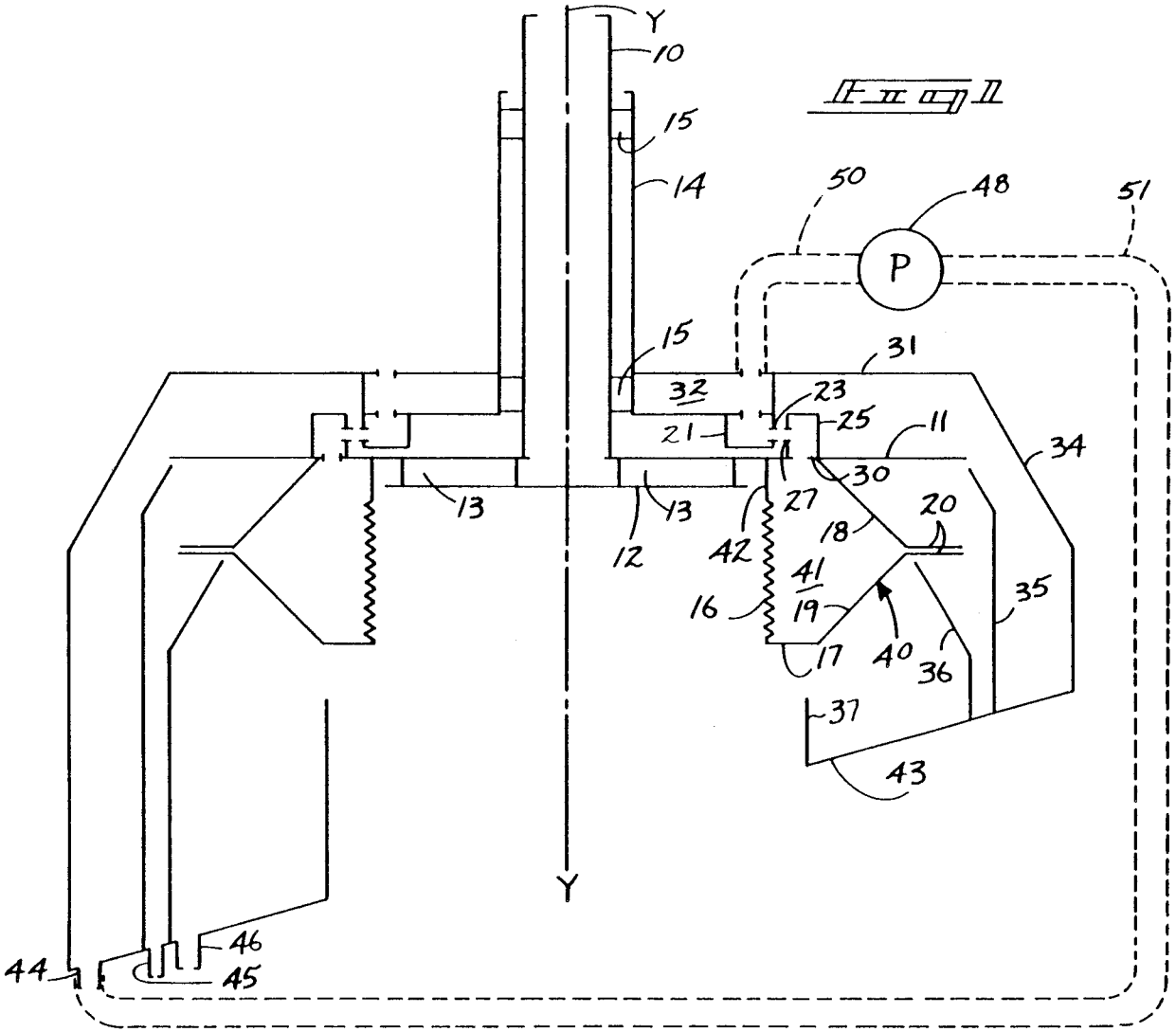
FIG. 1 is a diagrammatic line view of one embodiment of the invention.

Referring to FIG. 1, the centrifugal jig includes a jig rotor movably mounted for rotation about a reference axis Y—Y. The jig rotor includes a perforated screen 16 and a surrounding hollow fluid hutch 40. The rotor is powered externally to spin about axis Y—Y. Such power can be supplied by any external power drive (not shown).

The rotor screen 16 includes coaxial inner and outer surfaces centered about reference axis Y—Y. In the illustrated embodiments, the screen 16 is cylindrical. However, if desired, it might be polygonal in plan cross-section or tapered or conical in vertical elevation.

The hutch 40 has an interior space 41 normally filled with fluid during operation of the jig. The interior space 41 of the hutch 40 extends radially outward from screen 16 to a series of peripheral hutch orifices or outlets (described below). The hutch is kept filled by balancing the volumes of incoming slurry and pulse fluid supplied to the jig rotor with the volume of fluid discharged through the hutch outlets.

Feed means for directing incoming slurry to the inner surface of screen 16 is shown as a rotatable feed shaft 10. Its lower end is attached to an annular base plate 11 which suspends a circular slurry feed disk 12 by means of upright accelerator fins 13. As shown, the feed shaft 10 is rotatably supported within a surrounding tubular bearing housing 14 by interposed bearings 15.

Slurry directed through the feed shaft 10 will drop onto the horizontal rotating disk 12 and be flung radially outward between accelerator fins 13 to an annular deflector ring 42. The incoming slurry will then pass vertically downward over the inner surface of rotating screen 16, where it will be subjected to periodic fluid pulses directed radially inward from the outer surfaces of screen 16 by the fluid within interior space 41 of hutch 40. The slurry held against the inner surface of the jig screen by centrifugal force is periodically "jigged" by fluid pulses created by the interaction of a series of equiangularly spaced fluid supply nozzles and a series of complementary pulse blocks leading to the hutch interior. The pulse blocks are spaced apart from one another to assure free delivery of fluid from the nozzle outlets when not in registry with the pulse block inlets. The wall surface areas surrounding the pulse block inlets have an area substantially less than that of the nozzle outlet, assuring that there is no substantial blockage of the nozzle outlets during rotation of the equipment. Continuously flowing pressurized fluid is alternately diverted into a surrounding shroud enclosing the equipment or into the hutch. This provides a very sharp fluid pulse to the hutch interior, facilitating jigging of the slurry contents as they are subjected to substantial centrifugal forces on the spinning screen.

A stationary shroud 34 has an interior space enclosing the rotor. Shroud 34 is simply a solid-walled housing for the rotating equipment included in the centrifugal jig. It includes a transversely inclined bottom wall 43 along which the various fluid components move gravitationally to separate discharges 44, 45, and 46, which are located within the shroud 34 between partitions 35, 36 and 37. The nature of the fractions separated by the centrifugal jig and discharged through the respective outlets 44–46 will be self-evident to one familiar with the current technological state of centrifugal jigs.

In order to effectively direct jigging pulses to the fluid contained within hutch 40, a system is provided for periodically directing continuously flowing pressurized fluid into the interior space 41 during rotation of the rotor without ever completely obstructing the flow of fluid. The continuously flowing pressurized fluid is alternately diverted into the surrounding shroud 34 or into the interior space 41 of hutch 40. In this manner, the dynamic qualities of the continuously flowing incoming fluid will remain substantially constant, whether pulsing the hutch fluid or not.

The pulsing system includes at least one fluid nozzle, shown as outlet 23 (FIG. 1). The fluid nozzle is adapted to be in communication with a source of continuously flowing pressurized fluid, illustrated by a pump 48 and supply conduit 50. Pump 48 can be connected to any available fluid supply reservoir or tank (not shown) to provide makeup fluid to the system.

Pump 48 is also shown in FIG. 1 as being interconnected to a return conduit 51 extending from shroud outlet 44, through which diverted fluid is recycled.

The outlets 23 of the fluid nozzles are located within the interior space within the shroud 34, They are arranged in a first arcuate path centered about the reference axis Y—Y.

Individual pulse blocks 25 are mounted to the rotor and spin with it about axis Y—Y. Each pulse block 25 has an outlet 30 in open communication with the interior space 41 of hutch 40. The pulse blocks 25 each also have open inlets 27 in communication with their respective outlets 30. They are arranged along a second arcuate path centered about the reference axis Y—Y to periodically overlap the fluid nozzle outlets 23 during rotation of the rotor.

In operation, continuously flowing pressurized fluid supplied to the nozzle outlets 23 can be alternately directed either to the interior space 41 of the hutch through the pulse blocks 25 or to the interior space within shroud 34. The physical dimensions of the nozzle outlets 23 and the wall areas surrounding the pulse block inlets 27 are such that the pulses are directed to the interior space 41 of hutch 40 without these surrounding wall areas ever completely obstructing flow of fluid through the nozzle outlets 23 as the rotor is spun about the reference axis Y—Y. It is to be noted that the incoming pressurized fluid does not merely seep into the interior space 41 of hutch 40. It is either freely diverted into the interior of shroud 34 at full fluid velocity or is directed into the interior space 41 of hutch 40 without interruption of its flow, depending upon whether or not the pulse ring outlets 23 are in registry with the pulse block inlets 27.

The pulse block inlets 27 are positioned relative to the reference axis Y—Y by a radial distance equal to or greater than the radius of screen 16. Thus, the fluid interfaces at the pulse block inlets 27 are maintained at a positive pressure relative to the surrounding atmosphere during rotation of the rotor, which assures that the interior of the hutch and the pulse blocks 25 will be filled with fluid at all times during operation of the jig.

When the dynamic forces of the constantly flowing pressurized fluid engage the hutch fluid, which is slightly pressurized and relatively static, the resulting pulse is a very abrupt shock wave, due to the resulting rapid deceleration of the incoming fluid stream. This can be compared to "water hammer" that occurs when a valve is rapidly closed. The resulting shock wave is transmitted throughout the fluid filling hutch 40, thereby subjecting the jigged materials within screen 16 to a rapid fluid pulse for separation purposes. It has been discovered that this sharp fluid pulse facilitates jigging and separation of materials on the screen 16 under the heavy centrifugal loadings used to facilitate the separation process.

Figure 4:
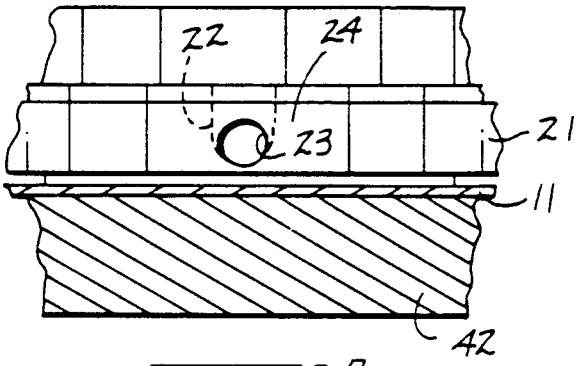
FIG. 4 is an fragmentary sectional view taken along line 4—4 in FIG. 2.
Figure 5:
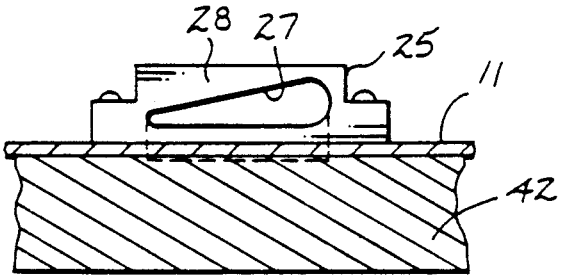
FIG. 5 is an fragmentary sectional view taken along line 5—5 in FIG. 2.
Figure 6:
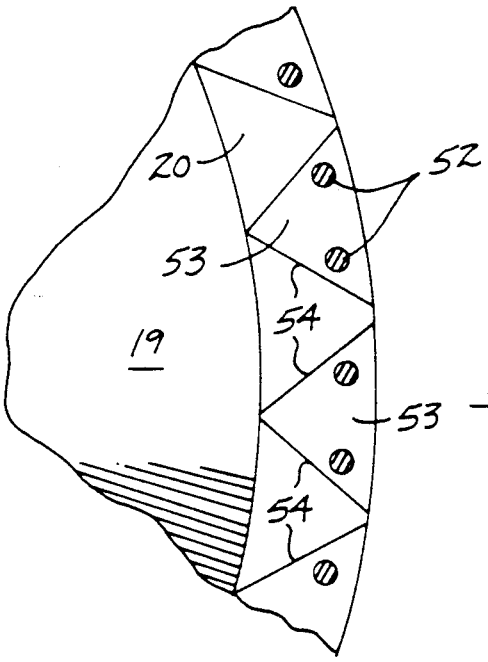
FIG. 6 is a fragmentary plan view taken along line 6—6 in FIG. 2.

The detailed drawings included in FIGS. 2–6 illustrate additional features of the equipment described with respect to FIG. 1. The lower end of screen 16 is supported by an annular hutch base plate 17. Upper and lower hutch walls 18, 19 are fixed between the rotating base plate 11 and the parallel hutch base plate 17 in opposed relationships. They are joined at annular flanges 20 by bolts 51 (FIG. 6).

The hutch walls 18, 19 include annular inner wall surfaces 52 that converge radially and axially toward facing annular surfaces presented by the flanges 20. The facing annular surfaces of the flanges 20 are axially spaced from one another by equiangularly spaced wedges 53 that define the hutch outlets across the outer circular edges of the flanges 20. The wedges 53 each include upright side surfaces 54 extending between the facing annular surfaces of flanges 20 which converge toward the outer circular edges of flanges 20. The hutch outlets are defined by the space between the side surfaces 54 of adjacent wedges 53 at the outer circular edges of the flanges 20, as shown in FIG. 6.

The side surfaces 54 of each wedge 53 also converge toward one another at the inner circular edges of flanges 20, thereby eliminating any concentric circular edges across the orifices of the hutch 40 on which solid material might collect due to the centrifugal forces to which they are subjected. The axially converging hutch inner walls 52 and the interspersed wedges 53 between flanges 20 assure that all solid particles within the interior space 41 of hutch 40 will flow through the hutch outlets and into the receiving shroud space defined by partitions 35 and 36, so as to be separated from solid particles falling off the bottom edge of the rotating screen 16.

Figure 2:
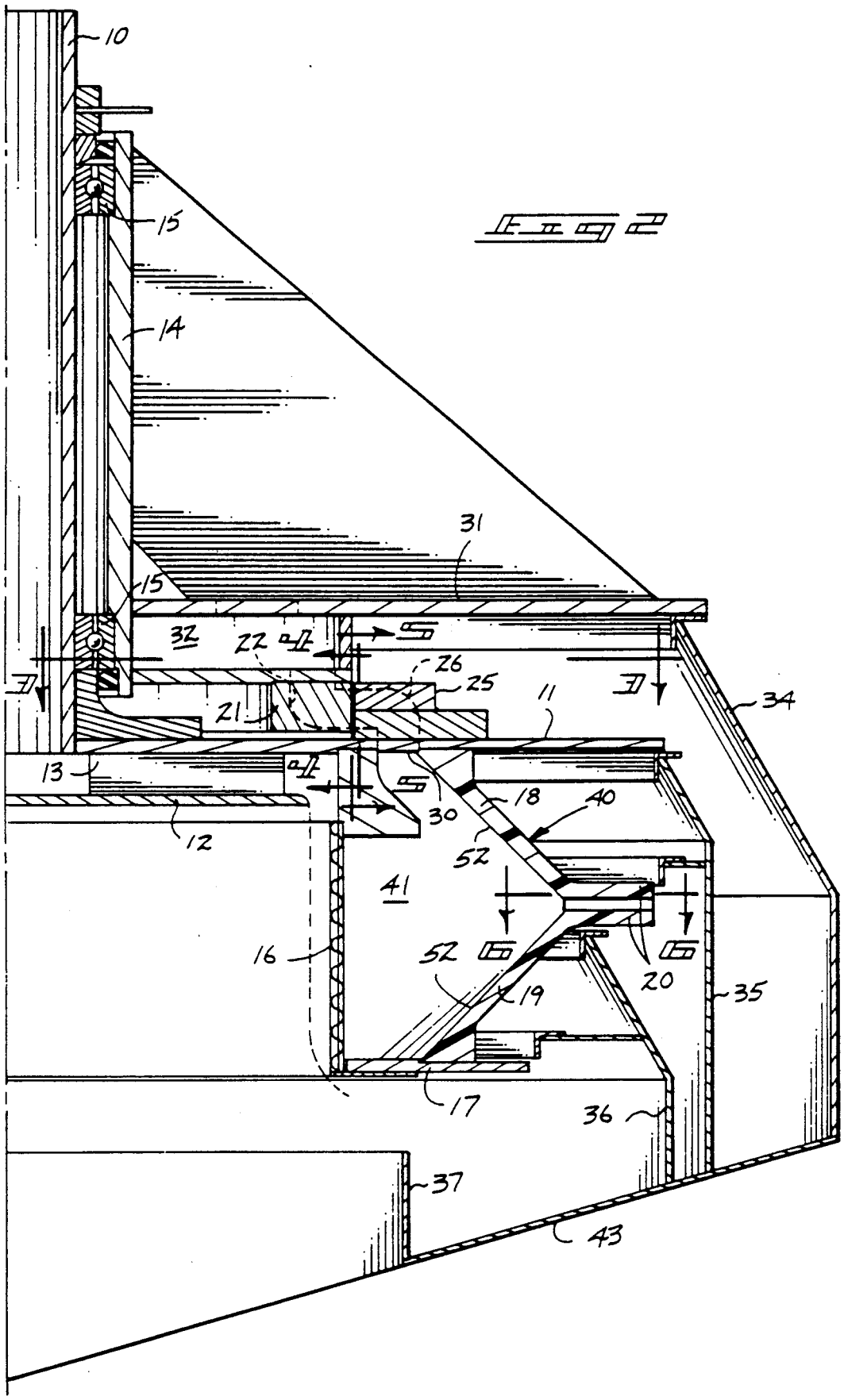
FIG. 2 is a vertical half-section of the embodiment.
Figure 3:
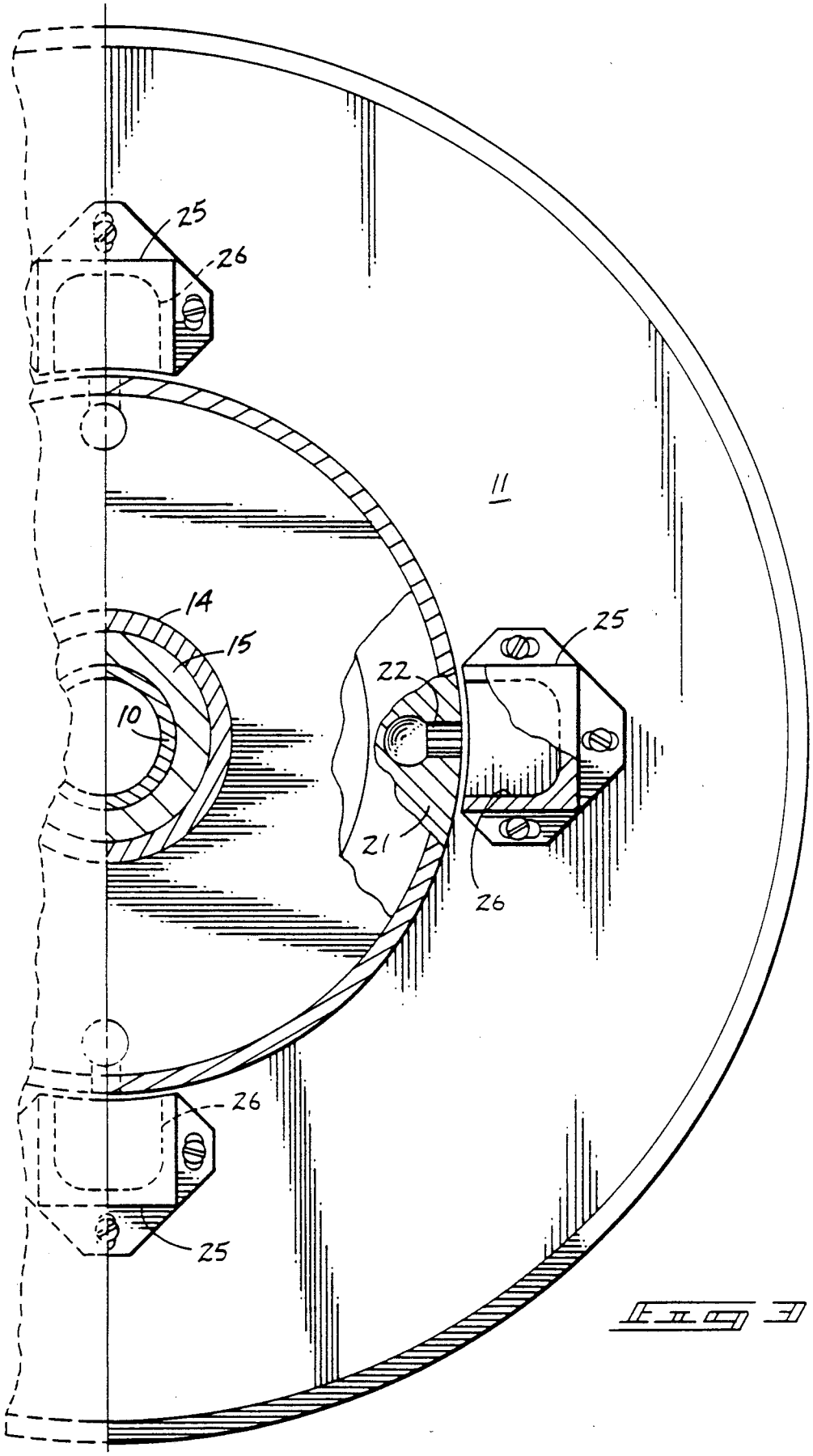
FIG. 3 is a sectional plan view as seen along line 3—3 in FIG. 2.

The details of pulse ring 21 can best be understood from FIGS. 2–4. The annular pulse ring 21 depends from a stationary fluid reservoir or manifold 32 covered by a circular mounting plate 31. Pulse ring 21 is provided with equiangularly spaced right angle openings 22 formed through it, which are in open communication with the pulse ring outlets 23 and the fluid within reservoir 32.

Each pulse ring outlet 23 is formed in the cylindrical peripheral wall 24 of the pulse ring 21. The surrounding surfaces of wall 24 are continuous solid cylindrical wall surfaces extending between the fluid nozzle outlets 23. They overlap the pulse block inlets 27 to prevent outward discharge of the pressurized fluid from within hutch 40 when the inlets 27 are not in registry with the fluid nozzle outlets 23.

The pulse blocks 25 can best be understood from FIGS. 3 and 5. Their inlets 27 are positioned on the rotating base plate 11 to overlap the nozzle outlets 23. The surrounding wall surfaces 28 that define the pulse block inlets 27 have an area that is substantially less than the area of each nozzle outlet 23. Thus, the surrounding wall surfaces 28 cannot substantially obstruct the flow of fluid through the outlets 23 as they pass each successive fluid nozzle.

The cross-sectional shape of the nozzle outlets 23 is preferably circular (FIG. 4). The cross-sectional shape of the pulse block inlets 27 is preferably elongated. In FIG. 5, the outlet 30 has a teardrop configuration tapering from a maximum height substantially equal to the diameter of the nozzle outlet 23 which is to be placed in registry with it. The initial wide section of inlet 27 assures a rapidly increasing pressure pulse within hutch 40, which then gradually decreases in intensity as the pulse block inlet 27 continues to pass by a nozzle outlet 23.

The number of nozzle outlets 23 and pulse block inlets 27 are illustrated as being equal. However, the number of nozzle outlets 23 can be any whole multiple of the number of pulse block inlets 27, assuring that all pulse blocks will be supplied with flowing pressurized fluid simultaneously. The number of pulse blocks 25 and the size of their inlets 27 and outlets 30 control the volume of pulsing fluid delivered to the interior space 41 of hutch 40 to maintain a proper fluid volume within the hutch 40 and along the screen 16 during flow of slurry through the jig.

Because the pulse ring 21 in FIG. 1 is stationary and the pulse blocks 25 rotate in unison with the supporting rotor, the pulses produced by this embodiment are a direct function of the rotor angular velocity about axis Y—Y. Where modification of pulse frequency is required, the pulse ring 21 can be independently rotated about axis Y—Y.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. A centrifugal jig, comprising:

a rotor movably mounted for rotation about a reference axis, the rotor including a perforated screen and a surrounding hollow hutch, wherein the screen includes coaxial inner and outer surfaces centered about the reference axis and the hutch has an interior space normally filled with fluid during operation of the jig, the interior space of the hutch extending radially outward from the screen to a series of peripheral hutch outlets;

feed means for directing incoming slurry to the inner surface of the screen;

a stationary shroud having an interior space enclosing the rotor;

at least one fluid nozzle, the fluid nozzle being adapted to be in communication with a source of continuously flowing pressurized fluid, the fluid nozzle having an open outlet defined by a surrounding solid wall arranged in a first arcuate path centered about the reference axis, the outlet of the fluid nozzle being located within the interior space of the shroud;

at least one pulse block mounted to the rotor, the pulse block having an outlet in open communication with the interior space of the hutch, the pulse block further having an open inlet in communication with its outlet, the pulse block inlet being defined by a surrounding solid wall arranged along a second arcuate path centered about the reference axis and being adapted to periodically overlap the fluid nozzle outlet to place them in open communication with one another during rotation of the rotor, the solid wall surrounding the pulse block inlet that overlaps the fluid nozzle outlet at any time during rotation of the rotor having an area that is substantially less than the area of the fluid nozzle outlet;

whereby continuously flowing pressurized fluid supplied to the fluid nozzle can be alternately directed either to the interior space of the hutch through the pulse block or to the interior space of the shroud to thereby periodically direct fluid pulses to the interior space of the hutch without ever completely obstructing flow of fluid through the fluid nozzle outlet while the rotor is rotated about the reference axis.

2. The centrifugal jig of claim 1, wherein the nozzle is stationary.

3. The centrifugal jig of claim 1 having a plurality of the fluid nozzles equiangularly spaced about the reference axis.

4. The centrifugal jig of claim 1 having a plurality of the pulse blocks equiangularly spaced about the reference axis.

5. A centrifugal jig, comprising:

a rotor movably mounted for rotation about a reference axis, the rotor including a perforated screen and a surrounding hollow hutch, wherein the screen includes coaxial inner and outer surfaces centered about the reference axis and the hutch has an interior space normally filled with fluid during operation of the jig, the interior space of the hutch extending radially outward from the screen to a series of peripheral hutch outlets;

feed means for directing incoming slurry to the inner surface of the screen;

a stationary shroud having an interior space enclosing the rotor;

a plurality of fluid nozzles arranged equiangularly about the reference axis, the fluid nozzles each being adapted to be in communication with a source of continuously flowing pressurized fluid, the fluid nozzles each having an open outlet defined by a surrounding solid wall arranged in a first arcuate path that is centered about the reference axis, the outlets of the fluid nozzles being located within the interior space of the shroud;

a plurality of pulse blocks mounted to the rotor, the pulse blocks each having an outlet in open communication with the interior space of the hutch, the pulse blocks each further having an open inlet in communication with its outlet, the pulse block inlets each being defined by a surrounding solid wall arranged along a second arcuate path centered about the reference axis and being adapted to periodically overlap the fluid nozzle outlets to place them in open communication with one another during rotation of the rotor, the solid wall surrounding each pulse block inlet that overlaps a fluid nozzle outlet at any time during rotation of the rotor having an area that is substantially less than the area of the fluid nozzle outlet;

whereby continuously flowing pressurized fluid supplied to the fluid nozzles can be alternately directed either to the interior space of the hutch through the pulse blocks or to the interior space of the shroud to thereby periodically direct fluid pulses to the interior space of the hutch without ever completely obstructing flow of fluid through the fluid nozzle outlets while the rotor is rotated about the reference axis.

6. The centrifugal jig of claim 5, wherein the fluid nozzle outlets are formed about the periphery of a common annular ring centered about the reference axis.

7. The centrifugal jig of claim 5, wherein the fluid nozzle outlets are formed about the periphery of a common annular ring centered about the reference axis and including continuous solid wall surfaces extending between the fluid nozzle outlets to overlap the pulse block inlets and prevent outward discharge of fluid from them when not in registry with the fluid nozzle outlets.

8. The centrifugal jig of claim 5, wherein the number of fluid nozzle outlets and pulse block inlets are equal to one another.

9. The centrifugal jig of claim 5, wherein the fluid nozzle outlets each have a circular cross sectional configuration, the pulse block inlets each having an elongated cross sectional configuration along the second arcuate path.

10. The centrifugal jig of claim 5, wherein the second arcuate path is radially positioned relative to the reference axis by a distance equal to or greater than the radius of the screen, whereby fluid interfaces at the pulse block inlets during rotation of the rotor are maintained at positive pressure relative to atmosphere.

11. The centrifugal jig of claim 5, wherein the hutch includes annular inner wall surfaces that converge radially and axially toward facing annular surfaces axially spaced from one another by equiangularly spaced wedges that define the hutch outlets.

12. A centrifugal jig, comprising:

a rotor movably mounted for rotation about a reference axis, the rotor including a perforated screen and a surrounding hollow hutch, wherein the screen includes coaxial inner and outer surfaces centered about the reference axis and the hutch has an interior space normally filled with fluid during operation of the jig, the interior space of the hutch extending radially outward from the screen to a series of peripheral hutch outlets;

feed means for directing incoming slurry to the inner surface of the screen; and pulse means for periodically directing fluid pulses to the interior space of the hutch during rotation of the rotor;

the hutch including annular inner wall surfaces that converge radially and axially toward facing annular surfaces;

the facing annular surfaces of the hutch being axially spaced from one another by equiangularly spaced wedges that define the hutch outlets.

13. The centrifugal jig of claim 12, wherein the facing annular surfaces extend radially between inner and outer circular edges;

the wedges each including side surfaces extending between the facing annular surfaces which converge toward the outer circular edges, the hutch outlets being defined by the space between the respective side surfaces of adjacent wedges at the outer circular edges.

14. The centrifugal jig of claim 12, wherein the facing annular surfaces extend radially between inner and outer circular edges;

the wedges each including side surfaces extending between the facing annular surfaces which converge toward the outer circular edges, the hutch outlets being defined by the space between the respective side surfaces of adjacent wedges at the outer circular edges;

the side surfaces of each wedge also converging toward one another at the inner circular edges.

15. A method of separating materials on a centrifugal jig having a rotor including a perforated screen with coaxial inner and outer surfaces centered about a reference axis and a surrounding hollow hutch enclosing an interior space extending radially outward from the screen to a series of peripheral hutch outlets, comprising the following steps:

rotating the rotor about the reference axis;

directing incoming slurry to the rotating inner surface of the screen; and periodically directing continuously flowing pressurized fluid into the interior space of the hutch during rotation of the rotor without ever completely obstructing the flow of fluid, the continuously flowing pressurized fluid being alternately diverted into a shroud enclosing the rotor when not being directed into the interior space of the hutch.

16. The method of claim 15 wherein the frequency at which the continuously flowing pressurized fluid is directed into the interior space of the hutch is a function of the rotational velocity of the rotor.

17. The method of claim 15 wherein the frequency at which the continuously flowing pressurized fluid is directed into the interior space of the hutch is independent of the rotational velocity of the rotor.

18. The method of claim 15 wherein the continuously flowing pressurized fluid is alternately diverted into a shroud enclosing the rotor when not being directed into the interior space of the hutch; and further comprising the following additional step:

recycling the diverted fluid into the continuously flowing pressurized fluid.

* * * * *